US010843309B2

(12) United States Patent
Joppich et al.

(10) Patent No.: US 10,843,309 B2
(45) Date of Patent: Nov. 24, 2020

(54) NON-WOVEN ABRASIVE ARTICLE, AND METHOD FOR MANUFACTURING SAME

(71) Applicant: VSM Vereinigte Schmirgel-und Maschinen-Fabriken AG, Hannover (DE)

(72) Inventors: Martin Joppich, Grossefehn (DE); Achim Jäger, Hannover (DE); Jörn-Oliver Nolte, Wunstorf (DE); Markus Flory, Garbsen (DE); Andreas Lange, Hannover (DE)

(73) Assignee: VSM Vereinigte Schmirgel-und Maschinen-Fabriken AG, Hannover (DE)

( * ) Notice: Subject to any disclaimer, the term of this patent is extended or adjusted under 35 U.S.C. 154(b) by 0 days.

(21) Appl. No.: 15/771,359

(22) PCT Filed: Oct. 28, 2016

(86) PCT No.: PCT/EP2016/076061
§ 371 (c)(1),
(2) Date: Apr. 30, 2018

(87) PCT Pub. No.: WO2017/072293
PCT Pub. Date: May 4, 2017

(65) Prior Publication Data

US 2018/0326556 A1 Nov. 15, 2018

(30) Foreign Application Priority Data

Oct. 28, 2015 (EP) ..... 15191975

(51) Int. Cl.
*B24D 11/00* (2006.01)
*B24D 3/28* (2006.01)

(52) U.S. Cl.
CPC ..... *B24D 11/005* (2013.01); *B24D 3/28* (2013.01)

(58) Field of Classification Search
None
See application file for complete search history.

(56) References Cited

U.S. PATENT DOCUMENTS 2,375,585 A * 5/1945 Rimer ..... B24D 11/005 451/532
2,958,593 A * 11/1960 Hoover ..... A47L 13/04 51/295

(Continued)

FOREIGN PATENT DOCUMENTS

DE 21 02 786 A1 8/1972
EP 0 912 294 B1 5/1999

OTHER PUBLICATIONS

International Search Report (ISR) in related PCT/EP2016/076061 dated Jan. 11, 2017 (6 pages).

*Primary Examiner* — Colleen P Dunn
*Assistant Examiner* — Ross J Christie
(74) *Attorney, Agent, or Firm* — Shlesinger, Arkwright & Garvey LLP

(57) ABSTRACT

Method for manufacturing a non-woven abrasive article, and non-woven fibers are made of a certain starting material and are subjected to method steps of forming a non-woven web, then consolidating the non-woven web. In order to improve the homogeneity, as well as the reproducibility of the non-woven abrasive article manufactured, the non-woven fibers, prior to the method step of forming a non-woven web and/or prior to the method step of consolidating the non-woven web, are coated with abrasive grains in such a way that the abrasive grains adhere to the certain starting material.

20 Claims, 7 Drawing Sheets

(56) References Cited

U.S. PATENT DOCUMENTS

Figure 1:
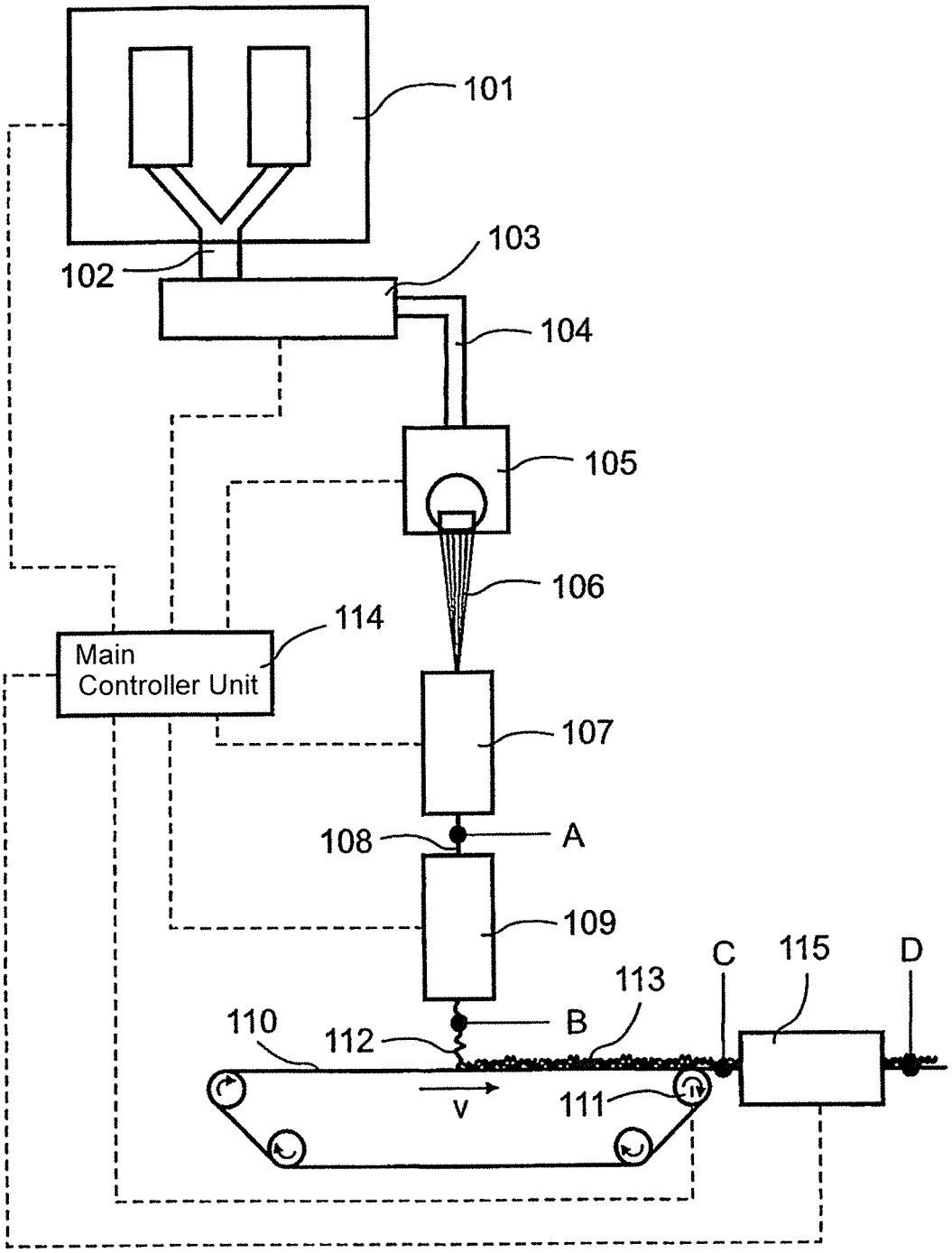

| | | | | | |
|---|---|---|---|---|---|
| 3,016,294 | A * | 1/1962 | Haywood | B24D 11/005 | 51/297 |
| 3,020,139 | A * | 2/1962 | Camp | B24D 13/00 | 51/295 |
| 3,324,609 | A * | 6/1967 | Stein | A47L 17/08 | 451/532 |
| 3,401,491 | A * | 9/1968 | Schnabel | A47L 13/02 | 51/295 |
| 3,817,004 | A | 6/1974 | Moss | | |
| 4,227,350 | A | 10/1980 | Fitzer | | |
| 5,500,273 | A * | 3/1996 | Holmes | B24D 3/28 | 428/147 |
| 5,701,643 | A * | 12/1997 | Fleissner | D04H 18/04 | 28/105 |
| 5,811,186 | A | 9/1998 | Martin | | |
| 2008/0199663 | A1* | 8/2008 | Burmeister | B29C 43/222 | 428/195.1 |
| 2014/0259960 | A1 | 9/2014 | Rotter | | |
| 2016/0367103 | A1* | 12/2016 | Daveloose | A47L 13/17 | |

* cited by examiner

NON-WOVEN ABRASIVE ARTICLE, AND METHOD FOR MANUFACTURING SAME

The invention relates to a non-woven abrasive article as well as a method for manufacturing the same.

In the publication EP 0,912,294 B1 the usual process steps for manufacturing a non-woven abrasive article are described. As starting material for such non-woven abrasive articles materials such as nylon, polyester or mixtures thereof may be used. The starting material is initially formed into a non-woven web, and subsequently the non-woven web is consolidated. At the end of these steps the non-woven web is a pre-bonded strip not yet incorporating any abrasive particles. Thereafter, the non-woven web is guided through a laminator and subsequently through a particle coater in order to apply the abrasive particles. A suitable artificial resin serves as bonding agent which is cured in a heater stage and then bonds the abrasive particles to the starting material.

During the process of running through the laminator and the particle coater it is often difficult to create the coating always consistently. Thus, in the afore-described manufacturing process, there is a problem in manufacturing the non-woven abrasive article having properties as homogenous and reproducible as possible.

Therefore, it is an object of the invention to improve the homogeneity as well as the reproducibility of the non-woven abrasive article.

That object is achieved by the features of claim 1 and claim 12.

Preferred embodiments are specified in dependent claims 2 through 11.

The method according to the invention is a method for manufacturing non-woven abrasive articles, whereby non-woven fibers of a certain starting material are subjected to the method steps of forming a non-woven web and then consolidating the non-woven web, whereby, prior to the method step of forming the non-woven web and/or prior to the method step of consolidating the non-woven web, the non-woven fibers are coated with abrasive grains in such a way that the abrasive grains adhere to the starting material.

Thus, an essential idea of the invention is to apply the abrasive grains onto the non-woven fibers prior to forming the non-woven web and/or prior to finally consolidating the non-woven web. Is had been shown that this leads to a much more consistent application of the abrasive grains onto the non-woven fibers because the non-woven fibers are accessible in a yet separated state.

According to a preferred embodiment, the non-woven fibers are made of a polyamide and/or of a polyamide composition and/or of nylon.

According to a further preferred embodiment, the formation of the non-woven web is carried out using a carding process and/or an aerodynamic process.

According to a further preferred embodiment, the consolidation of the non-woven web is carried out using a turbulence process, e.g. a water jet turbulence. Since, according to the invention, abrasive grains have already been added to the material supplied to the consolidation of the non-woven web, there is a danger of rapid wear of the tools used for consolidating the non-woven web. In this context, the water jet turbulence has the specific advantage that the non-woven web material must hardly be interfered with. The same advantages can be achieved also by consolidating the non-woven web using a thermal process, e.g. an ultra-sound solidification. In a particularly advantageous manner, turbulence processes and thermal processes may be combined in consolidating the non-woven web.

Generally, with the method according to the invention it is possible to apply the abrasive grains directly onto the not yet fully cured abrasive fibers. In accordance with another preferred embodiment the non-woven fibers are coated with an artificial resin prior to being coated with the abrasive grains, and this resin ensures bonding between the abrasive grains and the non-woven fibers.

Preferably, a light curing resin is used as artificial resin.

According to a further preferred embodiment, the non-woven fibers are coated continuously. However, it is also conceivable to coat the non-woven fibers intermittently. The intermittent coating may be of particular advantage when the average diameter of the abrasive grains is in the range of the average diameter of the abrasive fabrics or is larger than the latter so that it is useful to provide a controlled spacing between the abrasive grains along the non-woven fiber.

Further details and advantages of the invention shall be illustrated by means of the following Figures. These show in FIG. 1 a total view of an installation for manufacturing abrasive fibers, FIG. 2 a detail view of the bundling unit 107 from FIG. 1, FIG. 3 a detail view of the coating unit 109 from FIG. 1, FIG. 4 a detail view of the non-woven web consolidator unit 115 from FIG. 1, FIG. 5 a first variation of the installation from FIG. 1, FIG. 6 a second variation of the installation from FIG. 1, and FIG. 7 a third variation of the installation from FIG. 1.

FIG. 1 shows the total view of an installation for manufacturing abrasive fibers. According to its general design the installation consists of a mixer unit 101, an extruder 103, a spinning nozzle 105, a bundling unit 107, a coating unit 109 and a non-woven web consolidator unit 115.

The mixer unit 101 is connected to the extruder 103 via the connector flange 102. In the mixer unit different granulates can be mixed and the, in the mixed form, fed to the extruder 103. Of course, it is also possible to have the mixer unit make available only a single component to be fed to the extruder. As granulate, for example, polyester or polyamides can be used, such as nylon (PA 6.6 having the chemical name polyhexamethylene adipic acid amide). Examples for further polyamides are the following:

PA 69 (hexamethylene/azelaic acid)
PA 612 (hexamethylene diamine/dodecandioic acid)
PA 11 (11-aminoundecanoic acid)
PA 12 (laurolactam or ω-amino dodecandioic acid)
PA 46 (tetra methylene diamine/adipic acid)
PA 1212 (dodecane diamine/lauric acid)
PA 6/12 (caprolactam/laurolactam)

In the extruder 103 the das granulate is compressed under high pressure and melted. The molten granulate is then fed via the melt channel 104 to the spinning nozzle 105.

The spinning nozzle 105 is kept at the required spinning temperature (e.g. 290° C. for nylon) by means of a heater unit not shown in detail here. The spinning nozzle 105 is provided with a multiplicity of spinning apertures having, depending on the viscosity of the melt, a suitable diameter for spinning continuous yarns. With nylon, for example, the diameter per spinning aperture is 0.4 mm. The number of spinning apertures may vary strongly as a function of the required stability and the required diameter of the abrasive fiber, starting at a single spinning apertures up to several hundred spinning apertures. The spinning aperture itself, too, may be shaped in different ways. Besides a circular opening, for example, also a star-shaped aperture is conceivable, e.g. so as to improve the surface bonding properties of the artificial resin or bonding agent.

The threads 106 spun by the spinning nozzle are then consolidated on the intake of the bundling unit 107 where they are mixed and stretched to form a continuous yarn 108. A detailed description of the bundling unit 107 will be provided below in the context of FIG. 2.

Below the bundling unit 107 the letter A marks a first process interface. The first process interface A indicates that at this point there are various options of continuing to process the yarn 108. On option is as shown in FIG. 1, i.e. direct further processing in the coating unit 109. Another option is to wind up the yarn 108 at the first process interface A onto reels and to store these reels until later processing.

The yarn 108 bundled by the bundling unit 107 is then fed to a coating unit 109 in which the yarn 108 is sheathed by a resin and equipped to abrasive grains. A detailed description of the coating unit 109 will be provided below in the context of FIG. 3.

Below the coating unit 109 the letter B marks a second process interface. The second process interface B again indicates that at this point also there are several options available to further process the abrasive fiber 112.

One option is as shown in FIG. 1, i.e. the abrasive fiber 112 is placed, for direct immediate processing, e.g. on a conveyor belt 110. Using the drive 111 of the conveyor belt 110 the belt velocity v and thereby the density of the deposited material 113 can be controlled. Using the known methods of non-woven web processing the deposited material 113 can then, for example, by further processed into a non-woven abrasive article.

Another option of further processing the abrasive fiber 112 on the second process interface B is to wind up the yarn 112 and then to further process it using a weaving process into a fabric abrasive article.

Thus, in principle, on the process interface B, it is conceivable to further process the abrasive fiber into any types of abrasive articles.

The material 113 deposited on the conveyor belt 110 is then fed to a non-woven web consolidator unit 115 in which the loose fibers are compacted into a continuous non-woven abrasive article. A detailed description of the non-woven web consolidator unit 115 will be provided below in the context of FIG. 4.

Before the non-woven web consolidator unit 115 the letter C marks a third process interface. The third process interface C in turn indicates that at this point, too, various options are available of compacting the deposited material 113. The most relevant options are chemical bonding, thermal solidification, waterjet hydroentanglement and needling. All options may be combined by carrying out subsequent processing steps.

In the case of chemical bonding foam and liquid is applied. A light pre-solidification can be carried out using the water jet technology. Dehydration of the non-woven web happens through suction of the foam application. Thereafter, the web is dried using cylinder and flow-through dryers.

Thermal solidification is carried out by means of drum-type furnaces. Hereby, the non-woven fibers are compacted using heated air. The flow-through dryer method is based on a combination of screen drum and radial ventilator. The ventilator draws the air from the screen drum and guides it via heater elements back to the outside of the drum. This creates a suction draft on the surface of the drum which keeps the non-woven web on the drum while flowing through it at the same time. With this process it is also possible to employ several drums connected in series.

Waterjet hydroentanglement comprises, besides the central consolidator unit with several jet heads, also downstream spunlace drums as well as a compacting and dehydration system.

Needling machines for consolidating non-woven webs may be designed as single board or double board variations. Both types may be used with needling from top to bottom or from bottom to top. For certain use cases a tandem machine may be used where one board works from above and another board works from below.

After the non-woven web consolidator unit 115 the letter D marks a fourth process interface. On the fourth process interface C the finished non-woven abrasive article is available for assembly. Finally, the assembled non-woven abrasive product can be made available to dispatch.

The main controller unit 114 is connected in the manner shown to the afore-described components so as to measure and control the relevant process parameters.

Figure 2:
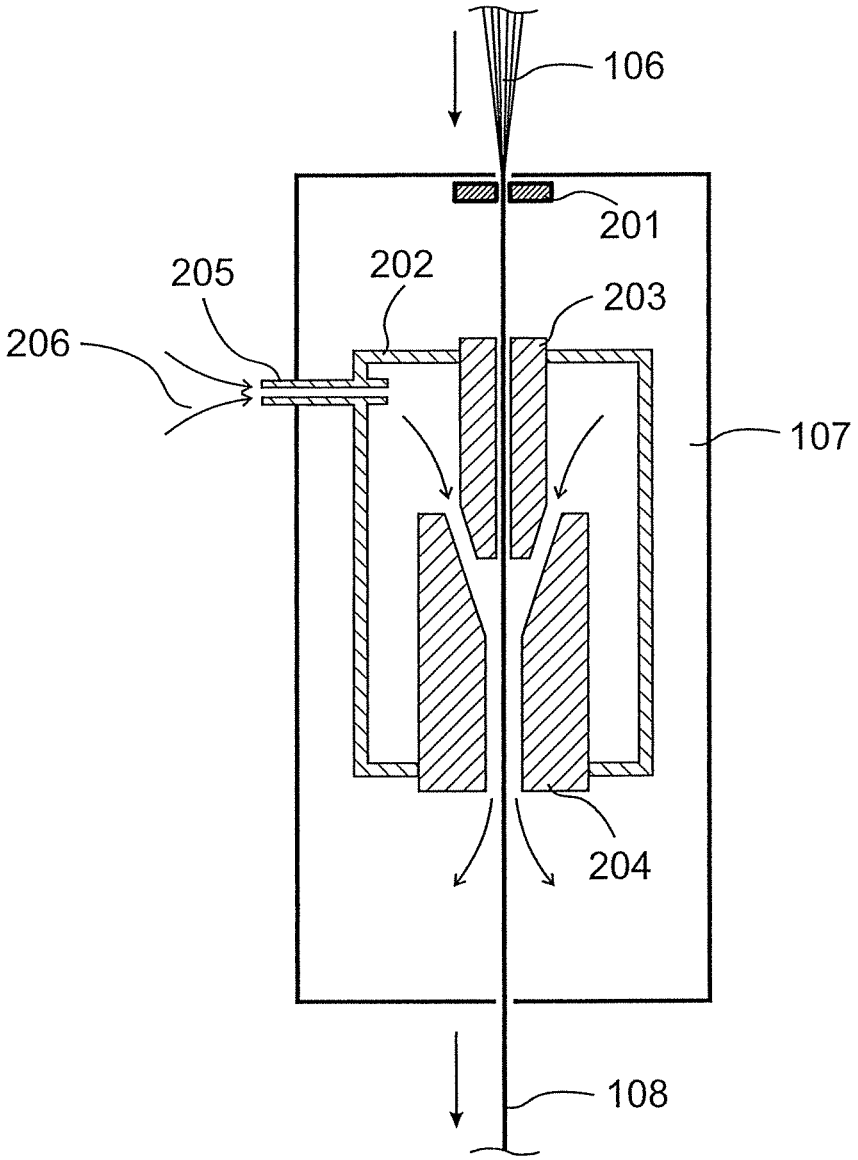

FIG. 2 shows a detailed view of the bundling unit 107 from FIG. 1. At the intake of the bundling unit 107 the freshly spun threads are first consolidated at the ring opening 201. A further task of the ring opening 201 is to centre the consolidated threads in relation to the downstream suction blaster unit 202. To that end the ring opening 201 can be adjusted in the plane perpendicular to the direction of transport of the consolidated threads by means of a positioning device not shown in detail.

The suction blaster unit 202 consists of a longitudinal guide unit 203, an air injector unit 204 as well as of a compressed air connector 205. The interior diameter of the longitudinal guide unit 203 is a little smaller (e.g. 2 mm) than the interior diameter of the air injector unit 204 (e.g. 3 mm). Compressed air at a pressure of e.g. 7 $kg/cm^2$ is connected to the compressed air connector 205 so that the compressed air will follow the path as indicated by the arrows 206. This generates a high velocity suction blast in the air injector unit 204. The velocity of flow at the centre of the channel may be several kilometres per minute. A typical flow velocity at the centre of the channel may be e.g. 3000 m/min.

The suction blast quenches the freshly spun threads 106 while at the same time crimping the threads among themselves in an irregular and random manner.

As the velocity of the yarn in relation to the flow velocity of the air exhibits a certain degree of slippage (e.g. 10%) the velocity of the yarn will be correspondingly smaller (e.g. 2700 m/min) that that of the air flow (e.g. 3000 m/min, as mentioned above).

Within the air injector unit 204 flow distortions and turbulences arise around the semi-solid threads causing the semi-solid threads to mix and cure, thereby forming a continuous yarn. Moreover, the air flow exerts a suction effect on the yarn within the air injector unit 204 so that the yarn is moved onward, narrowed and oriented, thus, finally leaving the bundling unit 107 as a continuous yarn 108.

Figure 3:
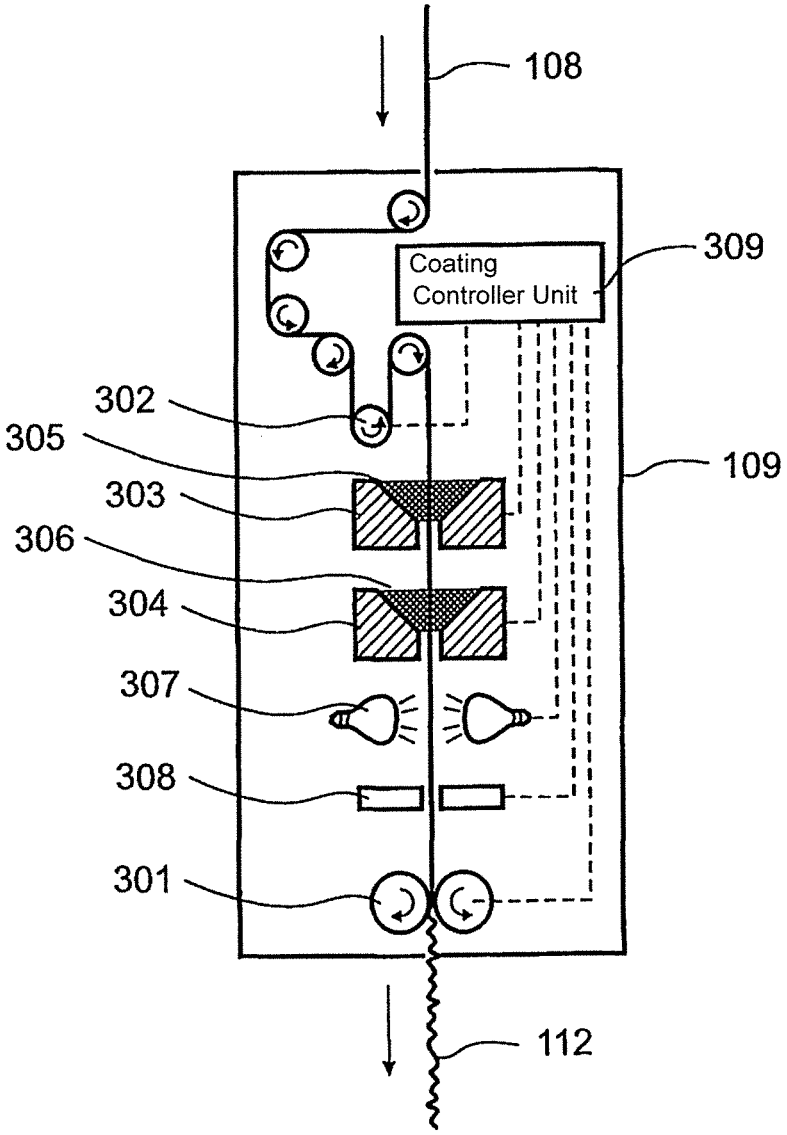

FIG. 3 shows a detailed view of the coating unit 109 from FIG. 1. In principle, the coating unit 109 comprises a take-off roll unit 301, a dancer roller unit 302, a primer coating nozzle 303, an abrasive coating nozzle 304, a UV irradiation unit 307 as well as a control measuring unit 308.

The take-off roll unit 301 serves to move the yarn 108 leaving the bundling unit 107 onward. The take-off rollers 301 are velocity-controlled in such a way that a loose yarn tension in the direction of transport ensues within the yarn 108 at the entrance to the coating unit 109. In order to compensate for fluctuations of the transport velocity a dancer roller unit 302 is provided in the known manner.

The primer coating nozzle 303 contains a primer or an adhesive respectively 305 so that on the yarn 108 an adhesive coating is created while the yarn 108 passes through the primer coating nozzle 303. The adhesive coating improves adhesion and the bonding properties of the following coating in the abrasive coating nozzle 304. The thickness of the adhesion coating can be adjusted via the feeding velocity of the adhesive 305 and, if applicable, also by means of an adjustable diameter of the primer coating nozzle 303.

The yarn 108 with the adhesive coating is then guided through the abrasive coating nozzle 304 which contains a mixture 306 consisting of a light curable resin, abrasive grains, and a filler. The mixture 306 adheres to the adhesive coating so that the desired abrasive layer is created on the outer diameter. The thickness of the abrasive coating can be adjusted via the feeding velocity of the mixture 306 and, if applicable, also by means of an adjustable diameter of the abrasive coating nozzle 304.

At this point a further variation of the above-described coating of the yarn will be described: Besides a continuous coating with the primer, the artificial resin, and the abrasive grains it is also possible to carry out the coating in an intermittent manner, i.e. with certain interruptions. One reason for choosing this may be that a continuous coating may lead to the yarn being too rigid against bending. In contrast thereto, thus, an intermittent coating could serve to adjust the desired flexibility and elasticity of the abrasive yarn in a highly precise and reproducible manner.

For realising intermittent coating it is conceivable for the die primer coating nozzle 303 and the abrasive coating nozzle 304 to each comprise controllable seals holding back or releasing the coating material in the desired manner. This way the primer coating nozzle 304 either alone or the primer coating nozzle 303 and the abrasive coating nozzle 304 together may be controlled in a constant cycle or in accordance with a certain cycle pattern in order to apply an intermittent coating onto the abrasive yarn in a specific targeted manner.

Behind the abrasive coating nozzle 304 the yarn 108 enters the UV irradiation unit 307 so that the light curing resin is cured and binds the abrasive grains. The wavelength of the UV light of the UV irradiation unit 307 depends on the respective artificial resin and may be e.g. in the range between 200 nm and 500 nm. Usually, the artificial resins used here happens at a wave band between 315 and 380 nm.

The abrasive yarn created in this manner finally passes through the control measuring unit 308 which measures the outer diameter of the abrasive yarn.

The coating controller unit 309 is connected to the described components in the manner shown so as to measure and control the relevant process parameters. Primarily, the outer diameter measured by the control measuring unit 308 is being evaluated so that, based on this evaluation, the parameters of the primer coating nozzle 303 and the abrasive coating nozzle 306 can be re-adjusted.

In addition, the atmosphere outside the coating unit 109 may consist of nitrogen or a gas with reduced oxygen content so as to attain a stabile polymerisation of the light curing resin.

By using the light curing resin the yarn 108 can be produced at very high speeds. Basically, speeds of several hundreds of 100 metres per minute up to several kilometres per minute are possible so that the production speed in the coating unit 109 can be matched to the speed of the yarn exiting the bundling unit 107.

In the following a possible composition of the mixture 306 will be described in more detail:

As filler material any suitable material can be used that is capable of increasing the mechanical strength or the abrasion resistance of the light curing artificial resin without having a negative effect on the curing process. Thus, the filler material acts as a type of support for the abrasive grains. In particular, further abrasive grains having a smaller diameter than the abrasive grains mentioned above may be used as filler material. Also, powders consisting of metal oxide, metal carbide or non-metal oxide or carbide or of metals may be advantageous, depending on the respective application.

In a particularly advantageous manner, therefore, fine abrasive grains having an average diameter of between about 2 μm and 10 μm may be used as filler material.

The abrasive grains may be made of aluminium oxide or alumina respectively, silicon carbide, CBN, diamond, zirconia alumina, etc. whereby the average diameter of the grains may be chosen depending on the abrasion application. For example, the abrasive grains may have an average diameter of 20 μm to 200 μm, corresponding to a grain size of about P800 to P80 in terms of abrasives.

The abrasive grains are added with about 5 percent by volume to the liquid of light curing artificial resin and may be pre-wet by means of a small amount of ethanol.

The liquid of light curing artificial resin may be e.g. an acrylate prepolymer (Oligomer or a Monomer), to which 1 percent by weight of acetolphenome derivatives is added as photoinitiator.

As mentioned above, the liquid of light curing artificial resin is based on a radical polymerisation whereby the radical polymerisation of the oligomer or monomer is induced by a free radical which is generated by the photoinitiator which is irradiated by the ultraviolet light. However, the oligomer, the monomer and the photoinitiator are not limited to these. It is also possible to use an unsaturated polyester as the oligomer and styrene as the monomer.

For the oligomer, for example, polyester acrylate, polyether acrylate, acrylic oligomer acrylate, epoxy acrylate, polybutadiene acrylate, silicon acrylate, or polyurethane acrylates can be used. For the monomer, for example, also N-vinyl pyrrolidone, vinyl acetate, monofunctional acrylate, bifunctional acrylate or trifunctional acrylate can be used. For the polymerisation initiator, for example, an acetophenone derivative, such as acetophonone or trichloric acetophenone, benzoine ether, benzophenone or xanthone can be used.

Moreover, for the light curing artificial resin instead of the radical polymerisation implementation a light addition polymerisation implementation, a light cationic polymerisation implementation or an acid drying or acid curing implementation can be used.

Figure 4:
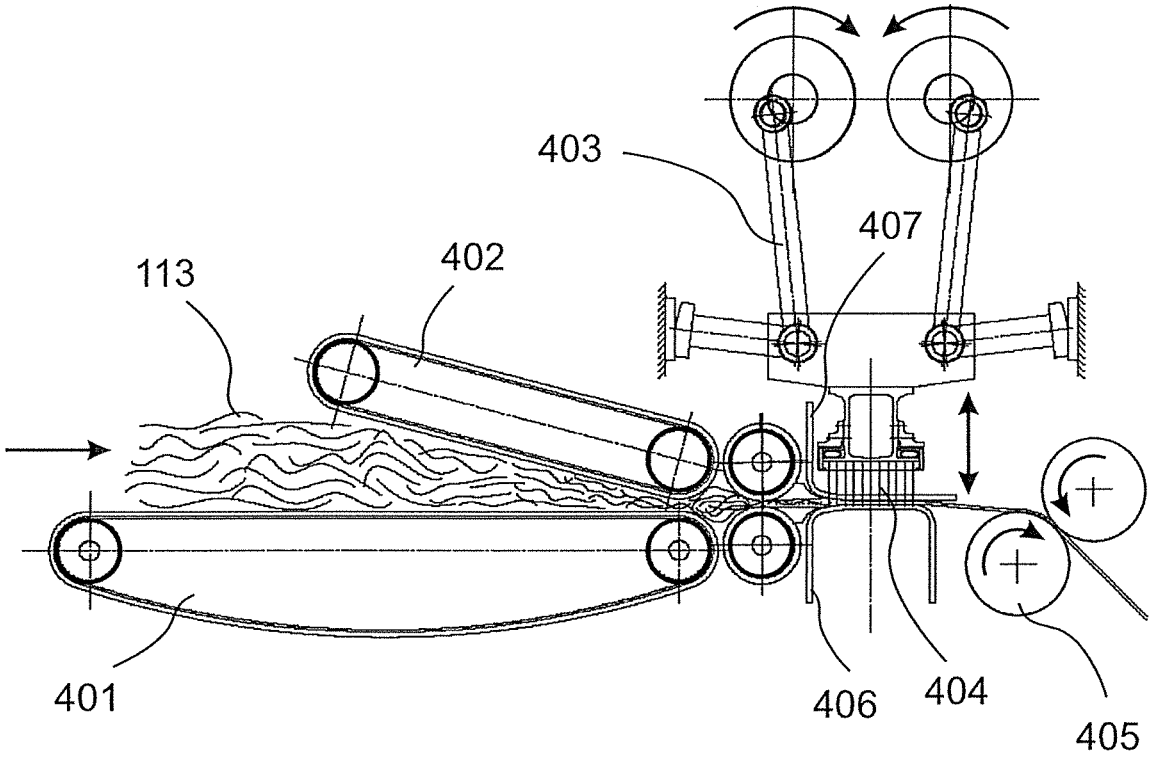

FIG. 4 shows a detailed view of the non-woven web consolidator unit 115 from FIG. 1. The task of consolidation of the non-woven web is to generate a thinner and firm area-measured fabric out of a high volume, soft non-woven web. Firstly, the creation of the non-woven web to a non-woven web material 113 happens by depositing the abrasive yarn 112 onto the conveyer belt 110 in accordance with FIG. 1. The non-woven web material 113 generated this way leaves the conveyer belt 110 horizontally and is fed on the subsequent conveyer belt 401 to the consolidation of the non-woven web via a further belt and roller system 402.

In the following, the consolidation of the non-woven web is described in more detail on the example of the needling technology. The kinematics of the vertical needle movement in the needling machines shown in FIG. 4 are realised by means of a crank mechanism 403 consisting of eccentrics and connecting rods and via linear guide. Permanently, with each revolution of the crankshaft, the needle girder 404 performs a linear upwards and downwards motion which over time progresses approximately in a sinusoidal manner. These oscillating double stroke movements happen at a certain stroke frequency and amplitude whereby stroke frequency and amplitude can be adjusted via the controller unit 114. Numerous needles are stringed in the so-called needleboard in accordance with an arrangement pattern orthogonally to the plane of the board parallel to each other. The needleboard itself is attached to the needle girder 404 which extends, as a rigid beam, across the working width.

For the passage of the non-woven web within the needling machine, parallel perforated sheets are arranged horizontally. When the needles penetrate the non-woven web from above, this will support the lower perforated slate as so-called throat plate 406 against puncturing forces from above. The perforated slate arranged parallel above it, the so-called downholder 407, strips it against the retraction forces of the needles. The surfaces of the throat plate and the downholder are smooth, guide the non-woven web and create, via their adjustable spacing, the space for the passage. A pair of take-off rollers 405 drives the needled non-woven web via a clamping gap by friction and imprints the take-off velocity upon it. However, as long as the needles are engaged the passage of the non-woven web in the passage zone remains stopped.

With reference to the second process interface B according to FIG. 1, the depositing and the forming of the non-woven web on the conveyer belt shall now be illustrated in more detail. In order to be able to deposit the abrasive yarn 112 across the entire width of the conveyer belt 110, a device, not shown in detail here, capable of positioning the abrasive yarn 112 prior to depositing in a manner perpendicular to the direction of transport v is provided. To that end the abrasive yarn 112 may be guided, at the second process interface B, e.g. through a loop that is moved back and forth along a tie bar perpendicular to the direction of transport v. In the same manner, it is also possible to correspondingly move back and forth the entire coating unit 109 or, vice versa, the conveyer belt 110. In addition hereto or as an alternative, an air flow unit may be utilised to deposit the abrasive yarn 112 by means of a purposefully varying air flow onto various positions of the conveyer belt 110.

Figure 5:
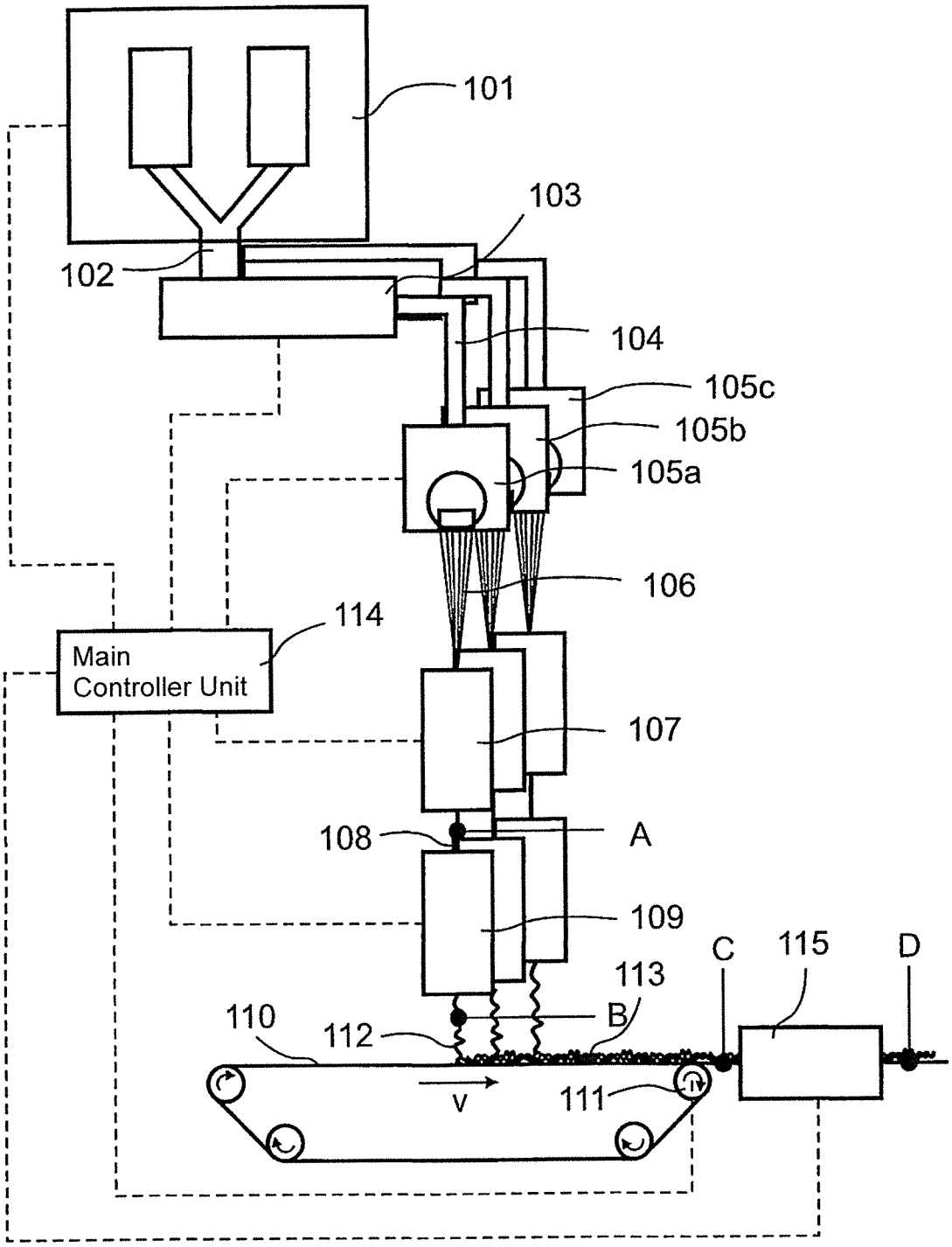

As an alternative to creating a single abrasive yarn 112 it is still also possible to provide, perpendicular in relation to the direction of transport, several spinning nozzles 105 or, respectively, one spin girder with several spinning nozzles. In this context, FIG. 5 shows a first variation of the installation from FIG. 1. The reference numerals in FIG. 5 correspond to the reference numerals from FIG. 1 so that the reader can be referred to the description of FIG. 1 as far as the description of the components is concerned. Here, in contrast to FIG. 1, however, several spinning nozzles 105*a*, 105*b*, 105*c* are provided perpendicular to the direction of transport v which may be designed identical or differently, namely in such a way that the desired depositing of the abrasive yarn 112 happens across the entire width of the conveyer belt 110. The spinning nozzles may generate identical or different filament diameters.

Figure 6:
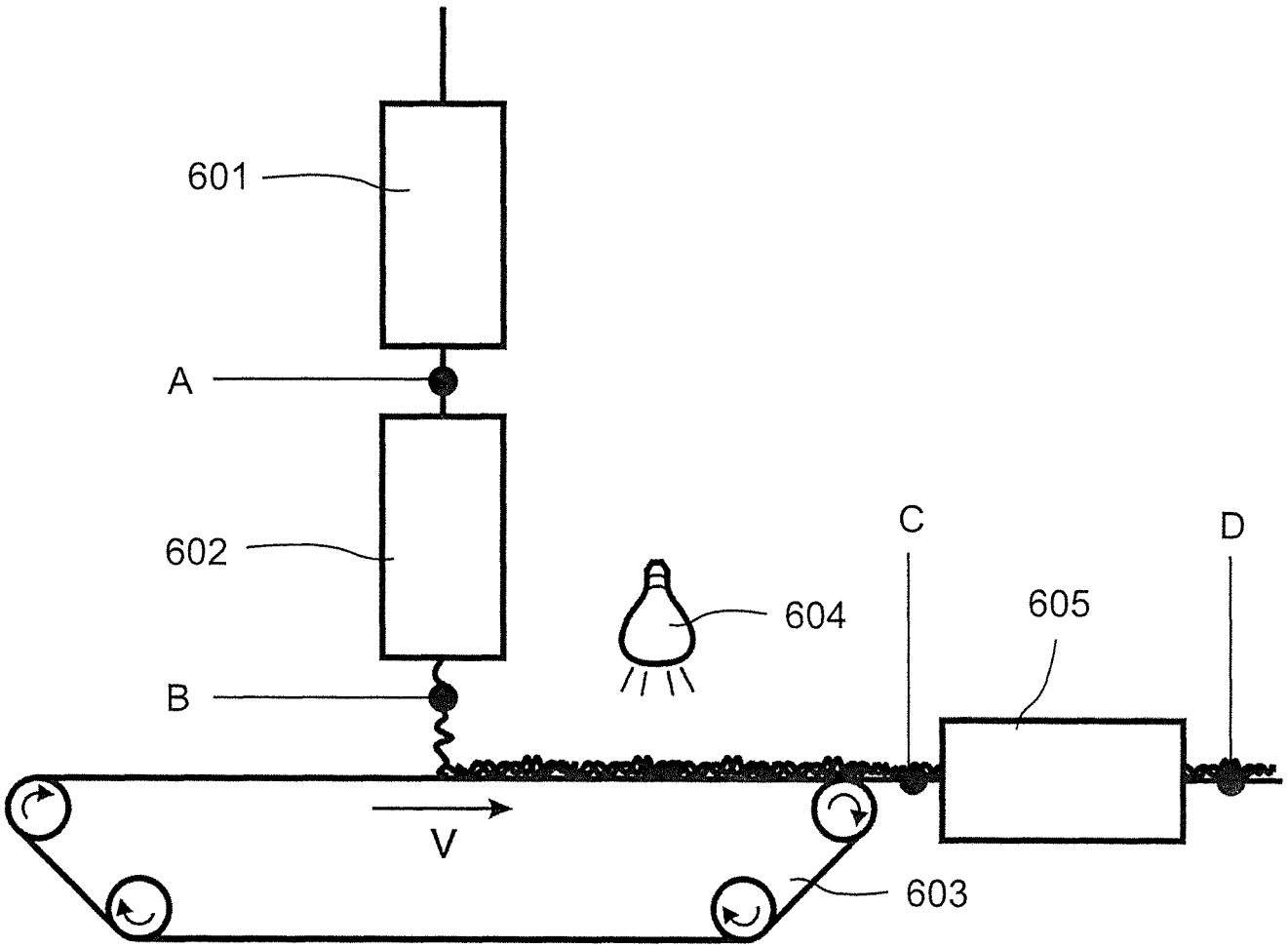

FIG. 6 shows a second variation of the installation from FIG. 1 comprising a stretching unit 601, an applicator unit 602 and a consolidator unit 605. The process interfaces A, B, C, and D correspond in principle to the process interfaces A, B, C, and D from FIG. 1; however, as far as the stretching unit 601 and the applicator unit 602 are concerned, differing variations are conceivable which will not be discussed in detail here.

First of all, the stretching unit 601 may be designed like the bundling unit 107, as shown in detail in FIG. 2. Likewise, the applicator unit 602 may be designed like the coating unit 109, as shown in detail in FIG. 3. The same applies to the consolidator unit 605 which may be designed like the non-woven web consolidator unit 115 shown in detail in FIG. 4.

However, as a variation of the coating unit 109, it is also conceivable to entirely dispense with the artificial resin and the primer in the applicator unit 602 and to deposit the abrasive grains directly onto the not yet fully cured yarn or the yarn surface made plastic again. Again, for coating a coating nozzle may be utilised such as described in accordance with the abrasive coating nozzle 304 in FIG. 3. In addition or as an alternative, it is also possible to create a bonding between the abrasive grains and the yarn electrostatically, similar to carrying this out with planar abrasives on a substrate.

A further variation is to carry out the drying or curing respectively of the artificial resin only after the abrasive yarn has been deposited onto the conveyer belt 603. The curing may happen by means of UV radiation or by means of conventional thermal drying or drying by other means. To indicate this situation, as an example, a thermal dryer unit 604 is shown above the conveyer belt 603 in FIG. 6. The basic rationale of this variation is to utilise the status of the not finally cured abrasive yarn to generate a certain degree of consolidation immediately upon depositing onto the conveyer belt 603.

Figure 7:
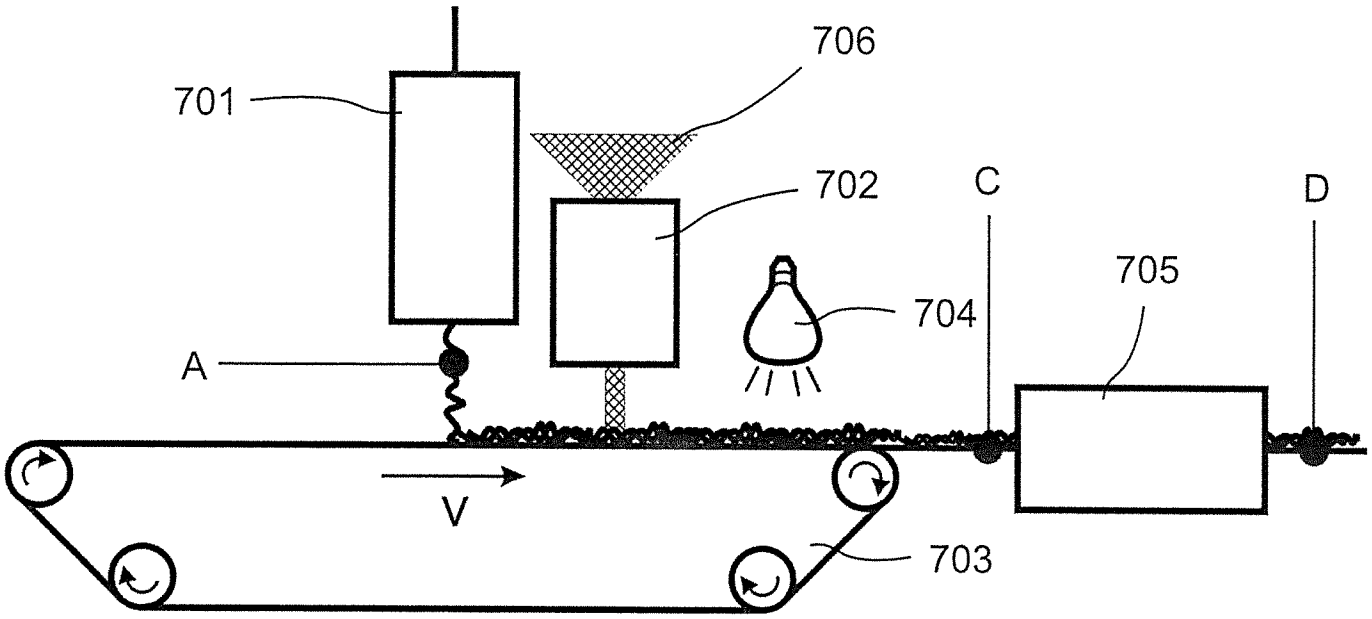

FIG. 7 shows a third variation of the installation from FIG. 1 comprising a stretching unit 701, an applicator unit 702 and a consolidator unit 705. The process interfaces A, C, and D correspond in principle to the process interfaces A, C, and D from FIG. 1 so that the stretching unit 701 may be designed as the bundling unit 107, as shown in detail in FIG. 2. The same applies to the consolidator unit 705 which may be designed as the non-woven web consolidator unit 115 as shown in detail in in FIG. 4.

According to the variation shown in FIG. 7, however, now the yarn is deposited onto the conveyer belt 703 already behind the first process interface A. As soon as the deposited yarn passes the applicator unit 702 the abrasive grain 706 is scattered or sprayed onto the deposited yarn. This is followed by drying or, respectively, curing using the dryer unit 704 as well as the consolidation using the consolidator unit 705.

The invention claimed is:

1. Method for manufacturing a non-woven abrasive article, comprising:

a) non-woven fibers made of a certain starting material are subjected to method steps of forming a non-woven web then consolidating said non-woven web;

b) prior to said method step of forming a non-woven web and/or prior to said method step of consolidating said non-woven web, said non-woven fibers are coated with abrasive grains in such a way that said abrasive grains adhere to said starting material; and c) said non-woven fibers, prior to being coated with said abrasive grains, are coated with an artificial resin.

2. Method according to claim 1, wherein:

a) said non-woven fibers are made of a polyamide or a polyamide mixture.

3. Method according to claim 1, wherein:

a) said non-woven fibers are made of nylon.

4. Method according to claim 1, wherein:

a) said forming of a non-woven web is carried out using a carding process.

5. Method according to claim 1, wherein:

a) said forming of a non-woven web is carried out using an aerodynamic process.

6. Method according to claim 1, wherein:

a) said consolidation of said non-woven web is carried out using a turbulence process.

7. Method according to claim 1, wherein:

a) said consolidating of said non-woven web is carried out using a thermal process.

8. Method according to claim 1, wherein:

a) a light curing resin is used as said artificial resin.

9. Method according to claim 1, wherein:

a) said non-woven fibers are coated continuously.

10. Method according to claim 1, wherein:

a) said non-woven fibers are coated intermittently.

11. Non-woven abrasive article, manufactured according to the method according to claim 1.

12. Method for manufacturing a non-woven abrasive article, comprising:

a) non-woven fibers made of a certain starting material are subjected to method steps of forming a non-woven web then consolidating said non-woven web;

b) prior to said method step of forming a non-woven web, said non-woven fibers are coated with abrasive grains in such a way that said abrasive grains adhere to said starting material; and c) said non-woven fibers, prior to being coated with said abrasive grains, are coated with an artificial resin.

13. Method according to claim 12, wherein:

a) said non-woven fibers are made of a polyamide or a polyamide mixture.

14. Method according to claim 12, wherein:

a) said non-woven fibers are made of nylon.

15. Method according to claim 12, wherein:

a) said forming of a non-woven web is carried out using a carding process.

16. Method according to claim 12, wherein:

a) said forming of a non-woven web is carried out using an aerodynamic process.

17. Method according to claim 12, wherein:

a) said consolidating of said non-woven web is carried out using a turbulence process.

18. Method according to claim 12, wherein:

a) said non-woven fibers are coated continuously.

19. Method according to claim 12, wherein:

a) said non-woven fibers are coated intermittently.

20. Method according to claim 12, wherein:

a) a light curing resin is used as said artificial resin.

* * * * *